US005632641A

United States Patent [19]

Sobel

[11] Patent Number: 5,632,641

[45] Date of Patent: May 27, 1997

[54] ELECTRICAL CONNECTOR

[75] Inventor: Jay R. Sobel, Ottawa, Canada

[73] Assignee: Northern Telecom Limited, Montreal, Canada

[21] Appl. No.: 385,939

[22] Filed: Feb. 9, 1995

[51] Int. Cl.[6] ..... H01R 13/62; H01R 13/46; H01R 13/00

[52] U.S. Cl. ..... 439/352; 439/357

[58] Field of Search ..... 439/350, 351, 439/352, 353, 354, 355, 357, 358, 345, 347

[56] References Cited

U.S. PATENT DOCUMENTS

| | | | |
|---|---|---|---|
| 4,580,192 | 4/1986 | Beun | 439/352 |
| 4,582,378 | 4/1986 | Fruchard | 439/352 |
| 4,904,201 | 2/1990 | Pelletier | 439/352 |
| 5,213,533 | 5/1993 | Walden | 439/358 |
| 5,310,358 | 5/1994 | Johnson et al. | 439/358 |

*Primary Examiner*—Hien Vu
*Attorney, Agent, or Firm*—R. J. Austin

[57] ABSTRACT

Electrical connector having a latch to hold it to a support in working position. Included is a pivoted handle which normally lies close to the connector body, but which is accessible to allow it to be moved to a position for gripping to allow for connector removal from the support. The handle is connected to the latch so that as the handle moves to the position for connector removal, it automatically disconnects the latch thereby permitting withdrawal of the connector. Useful for connector positioning in confined spaces and allows for narrower circuit pack designs while also including essential latch mechanisms which, because of the narrow designs, are manually inaccessible.

6 Claims, 3 Drawing Sheets

ELECTRICAL CONNECTOR

FIELD OF THE INVENTION

This invention relates to electrical connectors.

DESCRIPTION OF PRIOR ART

In the electronics industry, it is customary for electronics modules to be disposed face-to-face in vertical stacked formation or alternatively face-to-face in horizontal array within frames. Such a module may comprise a single circuit board or multiple circuit boards provided with a front plate which, with the module in its frame faces forwardly for access purposes and provides the function of supporting connectors for in-coming electrical wiring or optical fibers for connection to the circuitry on the or each board. A front plate may form part of a casing of a circuit pack which provides a module, the casing enclosing one or more printed circuit boards.

Normally, the connectors on the front plate are easily removed manually should it be required to remove a module from the frame. Also, it is becoming a preferred requirement to hide electrical wires or optical fibers extending to connectors at the front of frames. This is being done by extending sides of the module forwardly beyond the front plates so as to form recesses with the front plates providing bases of the recesses. The wires or fibers are then fed along these recesses to their respective connectors and together with the connectors are hidden behind front covers which are placed over the recesses to shroud both wires or fibers and the connectors. This results in a tidy and organized arrangement in which wires or fibers to any particular module are separated from the wires or fibers to other modules and serves to protect them from damage at the fronts of the frames. Problems exist however in that space constraints within recesses render it virtually impossible to grip connectors for removal purposes. These constraints exist when connectors are placed very close together or when modules are made extremely narrow such that a person's finger cannot be inserted into recesses to grip the connectors to be removed.

SUMMARY OF THE INVENTION

The present invention provides an electrical connector which minimizes the above problem.

Accordingly, the present invention provides an electrical connector for use in a confined space, the connector having a connector housing, latching means for connection of the housing to a connector support when in the confined space, connector removal means for removing the connector from the confined space, the removal means being movable upon the housing between an inactive position in which the latching means is disposed in a latching position and an active position extending away from the housing so as to extend in the direction out from the confined space to enable the removal means to be manually gripped, and latch release means operable by movement of the removing means into the active position for releasing the latch means from the latching position to allow for removal of the connector.

With the connector according to the invention, with the removal means in the inactive position, then the whole of the connector may be located within the confined space; when used, for instance, on an electronic module a cover may be placed over the connector and any electrical wiring or optical fibers extending thereto. The connector may then be removed by causing the removal means to be moved into the active position. This should then position the removal means in a location for gripping purposes (whereas previously it would have been impossible to grip the removal means) and as the latching means is released with the removal means in the active position then removal of the connector is easy to accomplish.

In a practical arrangement the removal means is pivotally connected to the housing for its movement between its active and inactive positions. Thus, in the inactive position and when mounted inside a confined space, the removal means is virtually inaccessible for gripping purposes, but may be pivoted outwardly from the space to enable it to be gripped. With this arrangement the latch release means is preferably constructed with cooperable camming elements provided upon both the removal means and upon the latching means, the camming elements cooperating during movement of the removal means into the active position to move the latching means from the latching position.

The invention also includes an electronic module for location within a receiving station of a frame comprising a casing enclosing electronic elements, the casing having a front face formed with a recess for containing at least one electrical connector, the connector having a connector housing, latching means for connection of the connector to a mating connector with the connector positioned within the recess, connector removal means for removing the connector from the mating connector, and with the connector mounted within the recess with the removal means disposed within the recess, the removal means being movable upon the housing between an inactive position in which the latching means is disposed in a latching position and an active position in which the removal means extends outwardly from the recess to enable it to be manually gripped for connector removal purposes, and latch release means operable by movement of the removal means into the active position for releasing the latch from the latching position to allow for removal of the connector.

BRIEF DESCRIPTION OF THE DRAWINGS

One embodiment of the invention will now be described, by way of example, with reference to the accompanying drawings, in which.

DESCRIPTION OF PREFERRED EMBODIMENTS

Figure 1:
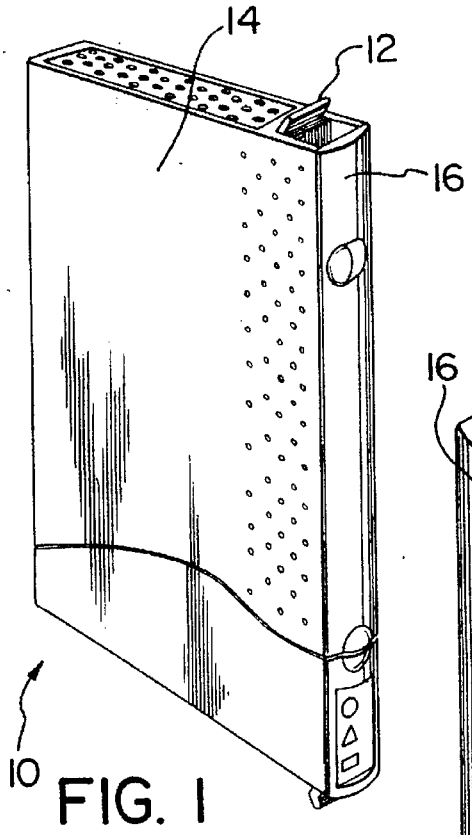
FIG. 1 is an isometric view from one side of an electronic module in the form of a circuit pack.

As shown in FIG. 1, a circuit pack 10 is vertically elongate for location in side-by-side relationship with other and similar circuit packs (not shown) in a shelf of electronic equipment. The circuit pack has top and bottom latches 12 of conventional form for enabling the circuit pack to be removed from within the shelf in conventional manner by sliding movement in a forward direction. The circuit pack comprises a housing having two sides 14 (FIGS. 1 and 2) and a front cover 16 which is easily removed and which covers a recess 18 (FIG. 2) extending rearwardly from the front of the connector as shown in that figure. The recess 18 is provided with a base wall 20 extending between the two sides 14 of the circuit pack and the sides 14 themselves which extend forwardly from the base wall 20 form sides of the recess. The recess contains a plurality of electrical connectors 22 each of which is connected by electrical wires or optical fibers within thin cables 24 extending to the shelf from some exterior position. The connectors 22 are each connected to mating connectors 25 which extend through the base wall 20 to interconnect the connectors 22 with electronic circuitry within the circuit pack.

Figure 3:
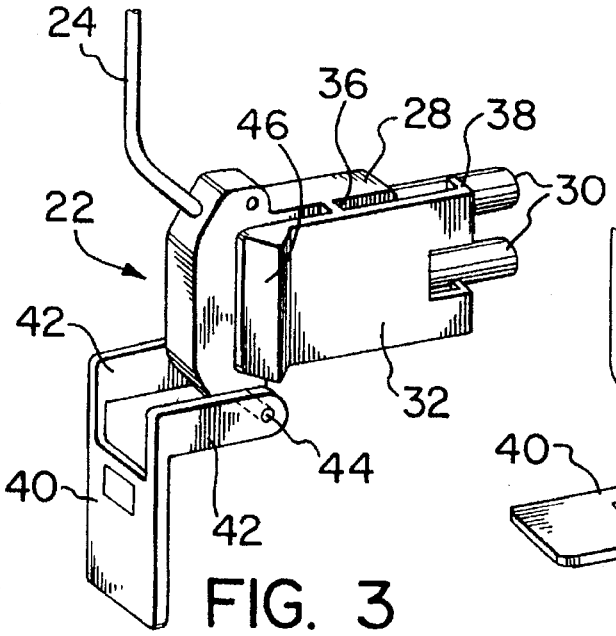
FIG. 3 is an isometric view in the same direction as in FIG. 2 of an electrical connector housed within a recess at the front of the circuit pack and showing the connector in a use position.
Figure 4:
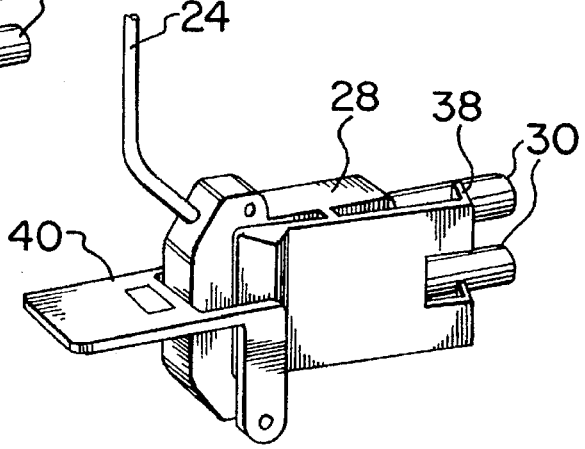
FIG. 4 is a view similar to FIG. 3 showing the connector in a position preparatory to removing it from the circuit pack.

Each of the connectors 22, as is more clearly shown in FIGS. 3 and 4, comprises a connector housing having a main body 28, into which the cable 24 enters, and an integral latching means for connection of the housing to the associated connector 25 so that terminals 30 of the connector 22 mate with corresponding terminals (not shown) of the connector 25. The latching means comprises a beam latch 32 which is integrally formed with the body 28 by being connected thereto by a neck 36 midway between two ends of the beam latch so that the latch is resiliently flexible upon the body 28 between the two positions shown in FIGS. 3 and 5 on the one hand and FIGS. 4 and 6 on the other. At one end of the latch 32, i.e. the end adjacent to the terminals 30, the latch has latching fingers 38 which extend towards the terminals 30.

Figure 2:
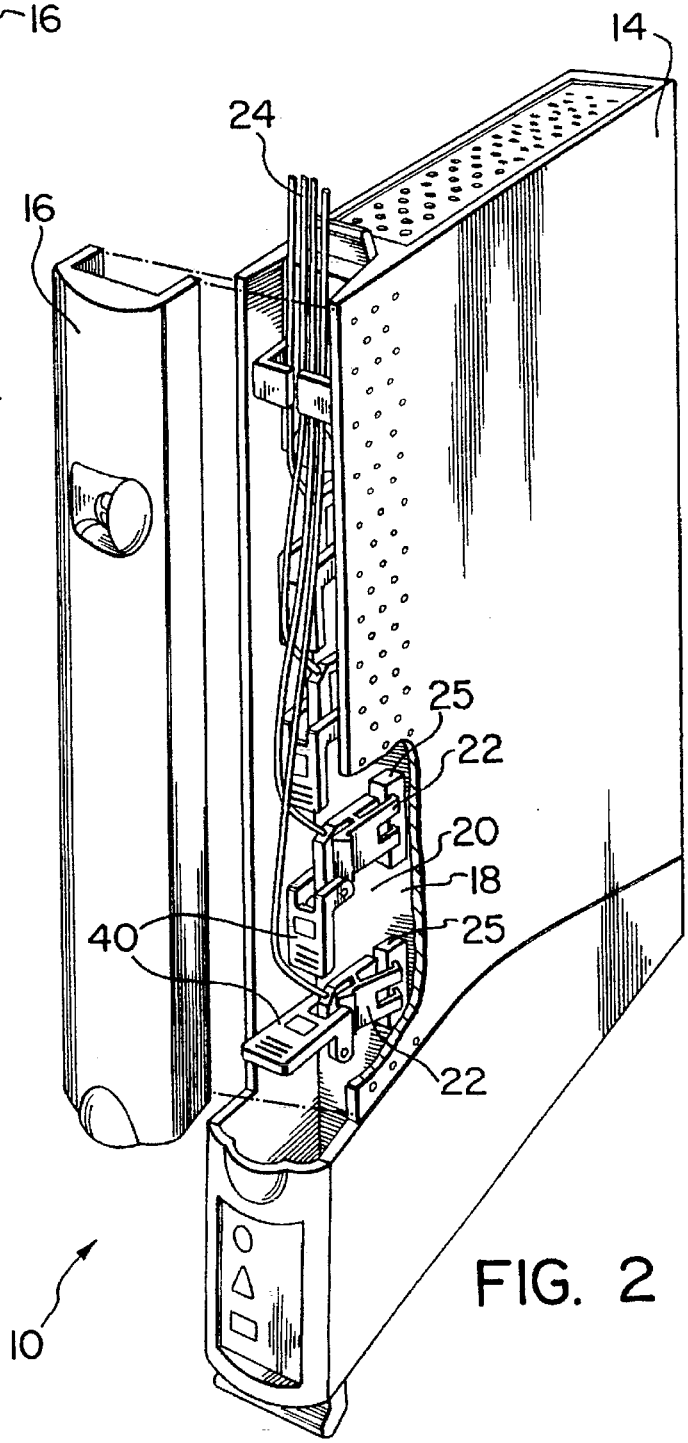
FIG. 2 is an isometric view of the circuit pack and from the other side and showing a front cover removed.

The connector 22 is also provided with a connector removal means for removing the connector from within the recess 18. As may be seen from FIG. 2 and particularly with regard to FIGS. 5 and 6, the circuit pack 10 is particularly narrow so that the recess 18 which is formed therein is exceedingly narrow and only provides sufficient width to form clearance for each of the connectors 22. As a result it is impossible to grasp a connector 22 with the fingers for removal purposes. The removal means mentioned above allows for removal of each of the connectors 22. This removal means comprises a handle 40 (FIG. 3) which normally hangs vertically downwards from the body 28 by means of two parallel legs 42 which extend at 90° to the plane of the handle 40 to pivotally connect the handle to a base region of the body 28 by a pivot pin 44. The position of the handle 40 at a front end of the connector 22 is such as to provide space between the handle and the base wall 20 (FIG. 2) to enable the handle to be gripped and raised into a horizontal position (FIGS. 2 and 4) by pivoting it about the pin 44. In the lower position of the handle 40 with the connector in use, the handle is completely positioned within the recess 18 partly for ease of covering with the cover 16 of the circuit pack, and also so as to provide a low profile to the connector for freedom of passage of the various cables 24 along the recess 18, for instance as shown by FIG. 2. The latch 32 at its front end, i.e. remote from the fingers 38, has part of a latch release means integrally formed therewith. This part of the latch release means comprises a cam surface which is in the form of an inclined surface 46 (see particularly FIGS. 3 and 4) which forms a tapered front end to the beam 34. A localized projection 48 formed substantially at the junction of a leg 42 with the handle 40 extends inwardly of the handle as shown in FIGS. 5 and 6 for coaction with the surface 46 as will now be described.

Figure 5:
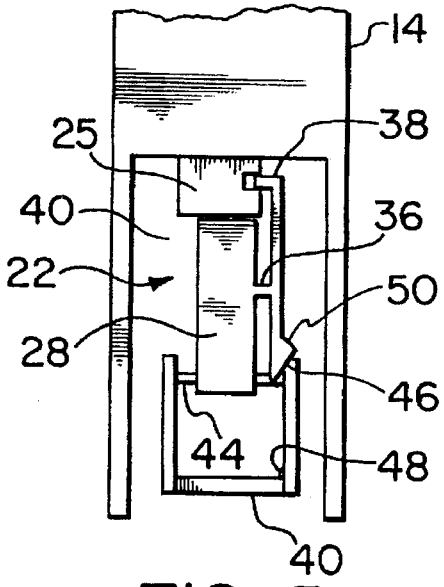
FIG. 5 is a view in the direction of arrow V in FIG. 3 of the connector.
Figure 6:
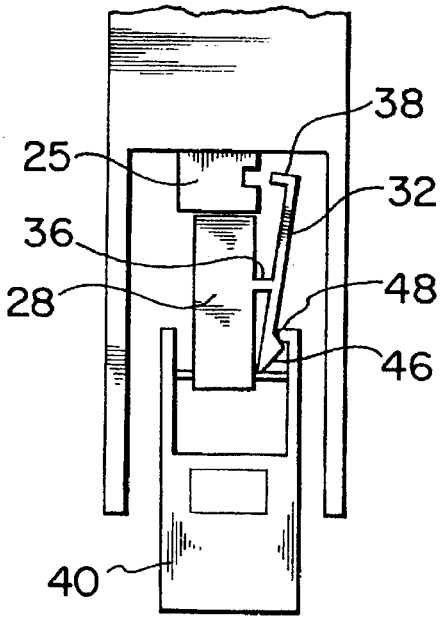
FIG. 6 is a view in the direction of arrow VI in FIG. 4 and showing the connector in its removal position.

Normally, as shown in FIG. 5, each connector 22 in its use position is disposed within the recess 18 with the latch fingers 38 received in corresponding recesses of the associated connector 25 extending through the base wall 20. In this position, the handle 40 normally hangs vertically as shown by FIG. 4 for the reasons described above. Should it be required to remove a connector 22 from within the recess, the handle 40 is easily raised by the tip of a finger or a suitable tool to the position shown in FIG. 4. During this movement, the projection 48 engages the front end of the surface 46 of the latch 32 and as upward pivoting of the handle continues into the position of FIG. 4, the projection 48 moves rearwardly along the surface 46. This provides an inward pressure on the surface 46 and causes the latch 32 to pivot about its neck 36 so that it assumes the pivoted position of FIGS. 4 and 6. This action causes the fingers 38 to become disengaged from and spaced from the recess within the connector 24. As a result, the handle 40 may be gripped and pulled forwardly so as to remove the connector 22 from within the recess and thereby disengage it also from the connector 25.

In a preferred arrangement, as shown in this embodiment, the rearward end of the surface 46 terminates in a sloping surface 50 extending in the opposite direction. In the upper position of the handle 40 as shown in FIG. 4, the projection 48 has moved from the rearward end of the surface 46 and down the surface 50 into a position such as shown in FIG. 6. This retains the handle 40 in its upper position so as to hold the latch fingers 38 removed from a position in which they may engage a connector 25. Thus the handle 40 may be moved into its horizontal and active position as shown by FIG. 4 and is retained in this position preparatory for connector removal.

Figure 7:
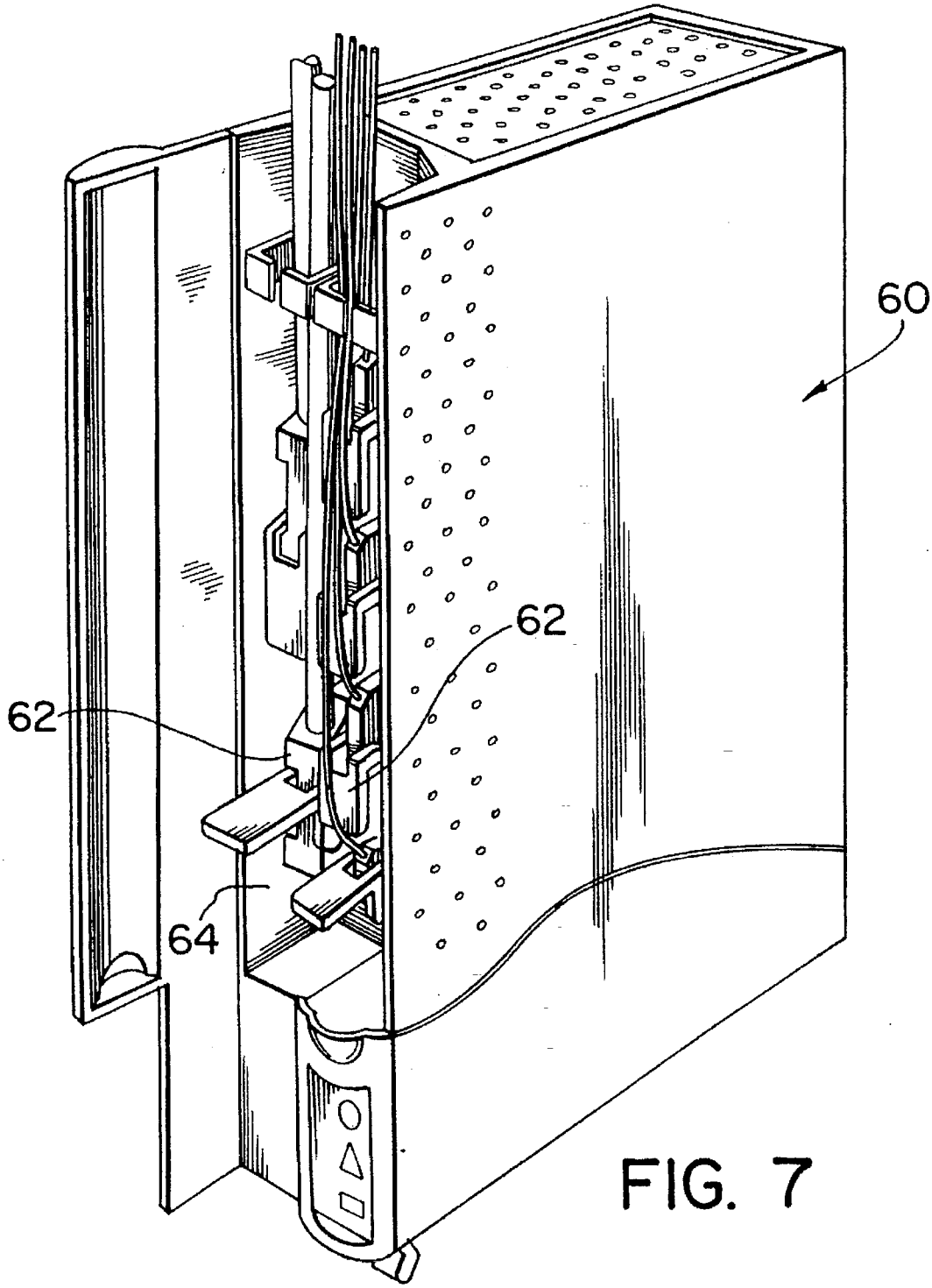
FIG. 7 is a view similar to FIG. 6 of a second embodiment.

The above embodiment illustrates that a connector according to the invention may be used in a very restricted space which is not accessible for enabling manual gripping of the connector itself for removal in a normal fashion by grasping the connector body. While in the embodiment, the sides of the recess provided by the circuit pack 10 provide the restriction for access purposes, in further arrangements, the restriction may be caused by the close side-by-side location of connectors themselves. This is shown particularly by a second embodiment in FIG. 7 in which a circuit pack 60 is constructed similarly to that of the first embodiment but is of thicker construction such as to enable connectors 62 to be disposed side-by-side within a recess 64 while still not allowing sufficient access for the connector bodies to be gripped by insertion of the fingers into the recess. The connectors 62 are of somewhat larger construction than those described in the first embodiment but have latching means and removal means which operate in a similar fashion to that discussed in the first embodiment.

In the second embodiment, the connectors 62 may have a single latching means similar to the beam latch 32 of the first embodiment. However, if the connectors 62 are of sufficient size (not shown), they may warrant a latching means on each side of a body of each connector. For instance a beam latch similar to the beam latch 32 of the first embodiment may be present on each side of the connector body, each latch provided with latching fingers for engagement within recesses of a mating connector extending into a base of a recess and into the circuit pack 60. Correspondingly, a handle of the connector has a cam operating projection at each side of the body for operation of the its associated latch.

What is claimed is:

1. An electrical connector for use in a confined space in an electronic module including a casing for receiving the electrical connector, the connector having:

a connector housing;

a beam latch having two end portions of an intermediate portion between the end portions with the beam latch integrally and resiliently flexibly connected to the connector housing by a lateral neck disposed at the intermediate portion and the beam latch being in a resiliently unstrained position at the lateral neck and in which the latch finger is disposed in a latching position;

and connector removal means pivotally mounted in a fixed pivotal position to the connector housing and having a handle and a camming element, the handle being movable to pivot the removal means in one direction by a pull on the handle in a specific direction to cause the camming element to actuate the cam and hence flex the beam latch from the unstrained position and remove the latch finger from the latching position, the electrical connector then being removable in the direction of pull upon the handle.

2. An electrical connector according to claim 1 wherein with the cam activating the camming element, the connector removal means resists pivotal movement of the removal means in the reverse direction.

3. An electronic module and electrical connector combinatin for location within a receiving station of a frame, the module comprising a casing enclosing electronic circuitry, the casing having a front face formed with a recess with the electrical connector mounted within the recess, the electrical connector having:

a connector housing;

a beam latch having two end portions and an intermediate portion between the end portions with the beam latch integrally and resiliently flexibly connected to the connector housing by a lateral neck disposed at the intermediate portion and the beam latch having a latch finger at one end portion latching the electrical connector within the recesss to the casing of the electronic module and having a projection including a cam surface at the other end portion of the beam latch;

and connector removal means pivotally mounted in a fixed pivotal position to the connector housing and having a handle and a camming element, the connector removal means being pivotally movable in onw direction by forward movement of the handle away from the front tace of the casing to cause the camming element to actuate the cam and resiliently flex the beam latch to remove the latch finger from latching connection with the casing of the electronic module, the electrical connector then being removable forwardly from the casing by a pull upon the handle.

4. A combination according to claim 3 wherein, with the cam activating the camming element, the connector removal means resists pivotal movement of the removal means in the reverse direction.

5. A combination according to claim 3 provided with a plurality of electrical connectors disposed side-by-side within the recess, the electrical connectors being disposed sufficiently closely to prevent any electrical connector from being gripped by insertion of a finger of an operator between adjacent electrical connectors, and the removal means of each electrical connector being accessible for forward movement of the handle to allow for removal of the electrical connector from within the recess.

6. A combination according to claim 3 provided with a plurality of electrical connectors disposed one above another, the recess being sufficiently narrow to prevent insertion of a finger of an operator between the side of the recess and the electrical connector, and the removal means being accessible for forward movement of the handle to allow for removal of the electrical connector from within the recess.

* * * * *